US008512514B2

(12) United States Patent
Tikka et al.

(10) Patent No.: US 8,512,514 B2
(45) Date of Patent: Aug. 20, 2013

(54) METHOD AND SYSTEM TO GENERATE STEAM IN A DIGESTER PLANT OF A CHEMICAL PULP MILL

(75) Inventors: Petri Tikka, Kotka (FI); Jarmo Kaila, Helsinki (FI)

(73) Assignee: Andritz Inc., Glens Falls, NY (US)

( * ) Notice: Subject to any disclaimer, the term of this patent is extended or adjusted under 35 U.S.C. 154(b) by 351 days.

(21) Appl. No.: 12/702,734

(22) Filed: Feb. 9, 2010

(65) Prior Publication Data

US 2010/0236733 A1 Sep. 23, 2010

(30) Foreign Application Priority Data

Feb. 9, 2009 (FI) ..... 20090039

(51) Int. Cl.
*D21C 1/02* (2006.01)

(52) U.S. Cl.
USPC ..... 162/68

(58) Field of Classification Search
USPC ..... 162/68
See application file for complete search history.

(56) References Cited

U.S. PATENT DOCUMENTS 5,378,320 A * 1/1995 Leclerc et al. ..... 162/49
6,176,971 B1 * 1/2001 Sun Yu et al. ..... 162/29
6,761,799 B2 * 7/2004 Tikka ..... 162/47

FOREIGN PATENT DOCUMENTS

WO 2007/073333 6/2007

OTHER PUBLICATIONS

Clay; Evaporation principles and black liquor properties published on Tappi website : http://www.tappi.org/content/events/08kros/manuscripts/3-1.pdf, published 2008.*

* cited by examiner

*Primary Examiner* — Eric Hug
*Assistant Examiner* — Jacob Thomas Minskey
(74) *Attorney, Agent, or Firm* — Nixon & Vanderhye P.C.

(57) ABSTRACT

A method for generating steam in a digester plant of a chemical pulp mill including: producing black liquor in the digester plant, extracting a first stream of black liquor from the digester; generating vapor by evaporating the first stream of black liquor by heating the first stream with fresh steam; heating fibrous material in the digester with the generated vapor from the evaporated first stream of black liquor; extracting a second stream of black liquor from the digester; flashing the second stream of black liquor to generate flashed black liquor and flashed black liquor vapor; introducing the flashed black liquor vapor to at least one heat exchanger to indirectly heat a clean evaporable liquid to produce clean steam from the clean evaporable liquid; and steaming, with the clean steam produced in the at least one heat ex-changer, cellulosic feed material before feeding the cellulosic feed material to the digester plant.

10 Claims, 1 Drawing Sheet

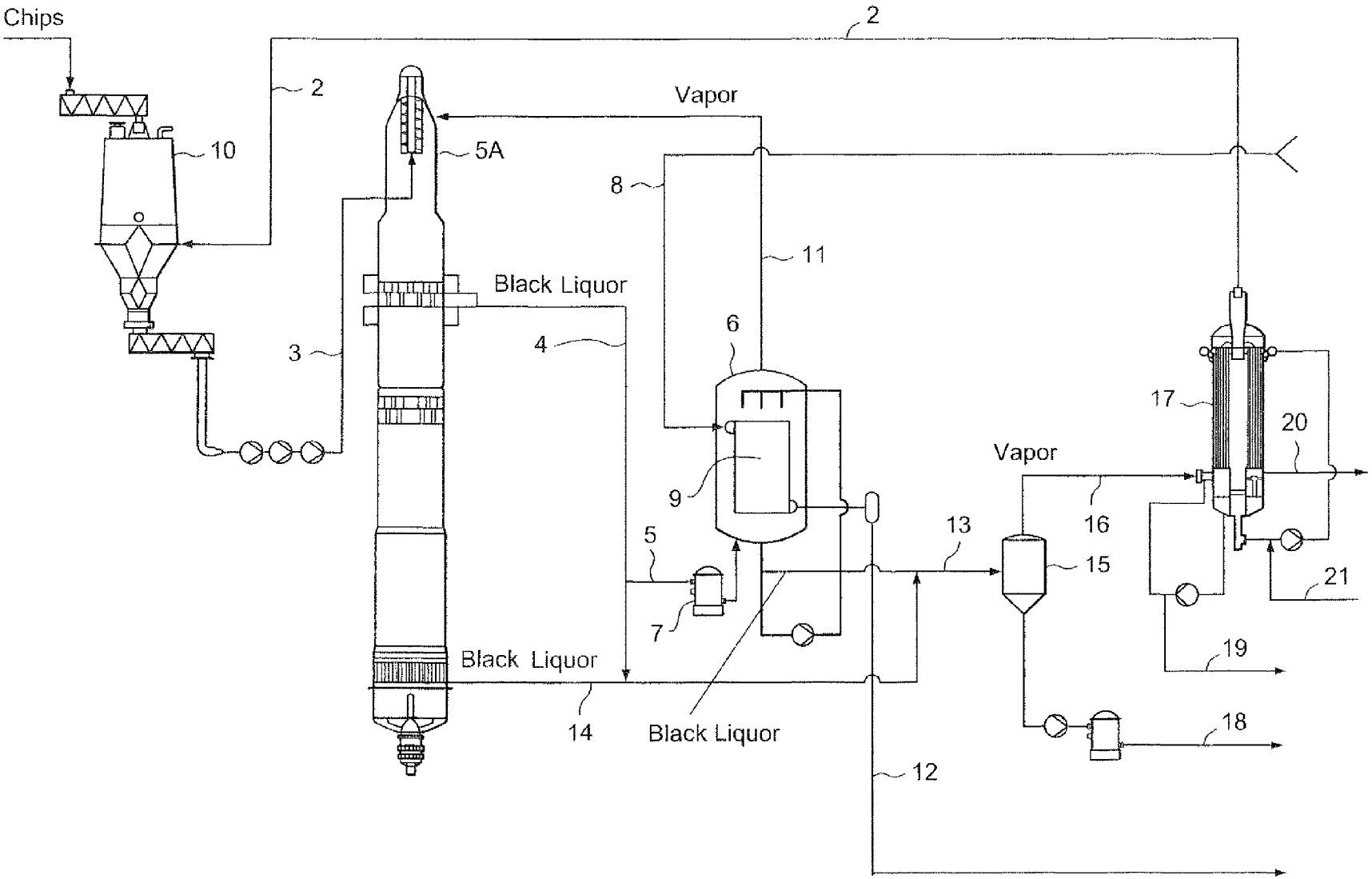
Chips
10
2
3
5A
Black Liquor
4
Black Liquor
Black Liquor
14
8
Vapor
5
7
9
6
11
Black Liquor
2
12
13
Vapor
15
16
17
20
21
19
18

METHOD AND SYSTEM TO GENERATE STEAM IN A DIGESTER PLANT OF A CHEMICAL PULP MILL

CROSS RELATED APPLICATION

This application relates to and claims priority to Finnish Patent Application No. 20090039 filed on Feb. 9, 2009, the entirety of which is incorporated by reference.

BACKGROUND OF INVENTION

The present invention relates to a method for generating steam from a black liquor in a digester plant of a chemical pulp mill.

Conventionally, fiberline systems have a chip bin where steaming of wood chips or other cellulose material occurs, liquid is added to form a slurry, followed by pressurization of the slurry (this section is also referred to as the feed system), fed to a treatment vessel or vessels (could be an impregnation vessel, a pre-hydrolysis process or other vessels), followed by a digester (this section is also referred to as the cooking system). Currently, at least one black liquor stream (typically at a temperature of 110-150° C.) is withdrawn from the cooking system. The extracted black liquor stream or streams are used as a source of heat to "pre-heat" white liquor, other black liquor streams, and/or other liquid streams being sent to the feed and cooking systems. The extracted black liquor stream (or streams) is then sent to the pre-evaporation system, e.g., two or more flash tanks where steam is produced from the hot black liquor as the liquor is cooled, typically to temperatures of approximately 95-110° C. At this point, the black liquor is sent to the evaporator system in the recovery area. The flash steam so produced can be used elsewhere in the pulping process. For example, flash steam can be used directly to presteam chips prior to cooking.

The above flashing process, though it has been successfully employed in conventional continuous digesters, has the drawback that the steam produced contains volatile compounds, including sulfur compounds, which are undesirable in the presteaming of wood chips. Typically, wood chips are steamed at atmospheric pressure, or slightly above, such that the residual gases not absorbed by the wood chips must be collected and treated. The treatment typically is carried out by combustion in a mill's noncondensable gas (NCG) system. However, this collection and treatment system becomes particularly significant when the steam used contains volatile compounds, including sulfur compounds, which have undesirable environmental impact, including noxious odor. It is therefore preferable to use a source of steam which minimizes or eliminates the introduction of volatile compounds to the steaming process.

Steam is also needed for heating the fibrous material to the cooking temperature in the vapor phase of the digester. In the known systems medium-pressure steam from the mill's turbine plant is typically used for this purpose. Due to the cost of energy, any further improvement to the energy efficiency of the chemical pulp mill is needed.

U.S. Pat. No. 4,944,840 discloses a process in which waste liquor discharged from a digester is evaporated in multiple evaporation stages. Vapors generated in the evaporation stages are directly introduced to the impregnation and cooking zones in a digester for heating the fibrous material.

SE patent 453,673 reveals a method in which a fibrous material is cooked with a cooking liquor while passing steam into the top of the digester where the fibrous material and the liquor flow continuously and are separated, the cooking liquor being recycled. According to the method, a part of the cooking liquor is extracted from the digester and led to a steam converter for production of steam. The steam is fed to the digester in order to heat the fibrous material introduced to the desired temperature.

A system is revealed in U.S. Pat. No. 6,722,130 for the generation of pure steam from black liquor. The pressure of the black liquor is first reduced in order to produce a second black liquor at a higher concentration and black liquor vapor, which is condensed to form a condensate. The condensate is heated by the first black liquor and expansion evaporated to produce pure steam which is used in a chip bin.

A system is revealed in U.S. Pat. No. 6,176,971 for the generation of pure steam to be used in the chip bin. Substantially clean useable steam is produced from a hot spent treatment liquor (e.g. black liquor) by passing the spent liquor to a reboiler, and then pressurizing (e.g. with an eductor, fan, or compressor) the clean steam discharged from the reboiler. The quantity of clean steam produced is increased by placing under negative pressure the pure steam side of the steam converter in the steam converter with a steam-driven ejector. The reduced pressure of the pure steam side ensures that more heat can be withdrawn from the black liquor, which in itself gives a greater quantity of steam, while the supply of steam to the ejector also contributes to the delivery of greater quantities of steam. In this case, however, the steam vapor formed consists of a mixture of pure steam that has been expelled from the process fluid and steam that has been taken from the steam supply network of the mill for driving the ejector.

A further process for the generation of pure steam is revealed in U.S. Pat. No. 6,306,252 for use in the chip bin, where the black liquor from the digester is led through a heat exchanger in which pure process water is heated, after which the pressure of the heated process water is reduced, such that pure steam is generated.

US Patent Application Publication 2007/0131363 discloses a method which comprises generating black liquor in a digester system, sending the black liquor to an evaporator system without using any pre-evaporator system, flashing the black liquor in the evaporator system to yield steam, and using at least some of the steam for chip steaming in a chip bin and/or for supplying in-direct heat exchangers in the digester system for pre-heating white liquor and/or filtrates for use in the digester system.

WO 2007073333 discloses a system and a method for the generation of steam in a digester plant for the production of chemical cellulose pulp. The pressure of hot, pressurized black liquor from a digester is reduced in a first step for the formation of black liquor steam that is used for the steam pre-treatment of the chips in a second pre-heating step. Pure steam for the steam pre-treatment of the chips in a first pre-heating step is formed through re-heating the black liquor the pressure of which has been reduced before a final subsequent pressure reduction, where the increased quantity of black liquor steam is led to a steam converter for the generation of pure steam.

WO 2008/057040 concerns a method which comprises an impregnation vessel in which to impregnate the chips, which chips are then fed to a subsequent digester vessel in a transfer fluid. A black liquor withdrawal is taken from the digester, which withdrawal is led to the bottom in order there to heat the chips before they are fed out from the impregnation vessel. A withdrawal of the transfer fluid is taken from the top of the digester and led to a position in order there to act as impregnation fluid in the impregnation vessel. At least a portion of the transfer fluid that was withdrawn from the top of the digester passes through an indirect heat exchanger, in which the transfer fluid withdrawn from the top of the digester at a temperature exchanges heat indirectly with a first fluid for the production of steam from the first fluid. The steam that is produced is then led to a steam pre-treatment position, upstream of the impregnation process, in order to heat the chips at said steam pretreatment position.

The known solutions provide different systems for producing cleaner steam for heating needs in the digester plant and for improving the energy economy of the pulp mill.

SUMMARY OF INVENTION

A method and system have been invented for the production of clean steam for steam pre-treatment of wood chips by utilizing the heat of black liquor and for the production of steam from black liquor for heating fibrous material in a digester. Steam and vapor is generated from black liquor so that the treated black liquor has better properties as regards the further treatment in the recovery area of the pulp mill. Further, the energy economy of the whole pulp mill can be improved with the method and system disclosed herein.

The present invention, in one embodiment, relates to a method for generating steam in a digester plant of a chemical pulp mill, in which method a) black liquor is produced in the digester system, b) a first stream of black liquor is extracted from the digester and evaporated using fresh steam as a heating medium to generate vapor and evaporated black liquor having an increased dry solids content, c) the vapor from the evaporation in step b) is used for heating fibrous material in the digester, d) a second stream of black liquor extracted from the digester is flashed to generate flashed black liquor and flash vapor, which is introduced to at least one heat exchanger, preferably a reboiler, into an indirect heat exchange contact with a clean evaporable liquid to produce clean steam, e) the clean steam from step d) is used for steaming chips, and f) the flashed black liquor from step d) is led to further evaporation.

Step d) may be practiced so that the evaporated black liquor from step b) and the second stream of black liquor extracted from the digester are combined before or during the flashing. The evaporated black liquor from step a) may have a higher dry solids content than the flashed black liquor from step d).

The clean evaporable liquid in step d) may be evaporator condensate, demineralized water, boiler feed water or clean enough water fraction.

The fresh steam may be condensed in the evaporation in step b) and fresh steam condensate thus produced is led to the mill's recovery boiler plant where it is used as feed water.

Step f) may be practiced so that the flashed black liquor from step d) is led together with the evaporated black liquor from step b) to further evaporation.

An embodiment of the present inventive method includes:

a) Required vapor to the digester top is produced by evaporating extraction black liquor in one or multiple stage evaporator(s) using fresh steam as a heating medium, and b) Odor-free steam for the steam pre-treatment of chips is generated by flashing extraction liquor and condensing the flash vapor in a re-boiler/s which exchanges heat indirectly in a reboiler/s with the condensate or pure enough water in order to produce odor-free steam. The steam that is produced is then led to a steam pre-treatment position to a retention and/or steaming vessel.

SUMMARY OF THE DRAWINGS

FIG. 1 shows schematically a system for generating steam in a digester plant and for treating black liquor.

DETAILED DESCRIPTION

FIG. 1 illustrates a system for generating steam in a digester 5*a* plant and for treating black liquor so that the heat efficiency of the cooking process is improved. The fiberline system comprises a chip bin 10 where steaming of wood chips or other cellulose material occurs with steam from line 2 (a line is a conduit such as a pipe), liquid is added to form a slurry, followed by pressurization of the slurry (this section is also referred to as the feed system) followed by a continuous digester 5*a* (this section is also referred to as the cooking system). Before the digester 5*a*, the slurry may be optionally fed to and treated in a treatment vessel or vessels (could be an impregnation vessel, a pre-hydrolysis process or other vessels, not shown). The slurry of chips and cooking liquid is fed via line 3 to the top of the digester 5*a* Only those components that are important for the invention are shown in the drawing, and other types of chips steaming or feeding or digester 5*a* circulations can, of course, be present in the digester 5*a* system. At least one black liquor stream (typically at a temperature of 120-160° C. and at a dry solids content of 12-17%), is withdrawn from the digester 5*a* through line 4 and introduced further through line 5 into an evaporator 6. Optionally, a pressurized fiber filter 7 can be located in the line 5 between the digester 5*a* and the evaporator 6 to allow the removal of fiber from the black liquor stream to a level of about 40 ppm leaving the filter. The fiber material removed from the filter would be in the form of a slurry to be returned to the digester 5*a* or feed system.

A fiberline system for production of chemical cellulose pulp is disclosed herein comprising a chip bin 10 where steaming of a cellulose material occurs using clean steam from a steam line 2, a feed system where liquid is added to the cellulose material to form a slurry, followed by pressurization of the slurry, optionally one or more treatment vessels where the slurry is treated prior to cooking, and a continuous digester 5*a* for cooking the slurry, said digester 5*a* comprising a first line 4, 5 for withdrawing at least one black liquor stream from the digester 5*a* and feeding it into at least one evaporator 6, wherein the black liquor is evaporated to generate secondary vapor and evaporated black liquor, and a second line 14, 13 for withdrawing at least one black liquor stream from the digester 5*a* and feeding it to a flash tank 15, wherein the pressure of the liquor is decreased to produce flash vapor and flashed black liquor, wherein the evaporator 6 further having a steam supply line 8 for supplying fresh steam to heat the slurry, a steam withdrawal line 11 for directing secondary vapor generated in the evaporator 6 to the digester 5*a* inlet, where said steam is used as heating steam for heating fibrous material in the slurry, a condensate line 12 for withdrawing condensated fresh steam from the evaporator, and a line for withdrawing evaporated black liquor from the evaporator 6, optionally feeding it to a flash tank 15, wherein the pressure of the liquor is decreased to produce flash vapor and flashed black liquor, said flash tank further 15 having a line 18 for withdrawing flashed black liquor and feeding it to the evaporation plant of the mill, and a vapor line 16 for directing flash vapor to a reboiler 17, where the vapor produces clean steam by indirect heat exchange with a clean, evaporable liquid, said reboiler 17 further having a steam line 2 for withdrawing clean steam and directing it to the chip bin 10, a line 21 for supplying clean, evaporable liquid to the reboiler 17, and one or more lines 19, 20 for withdrawing foul condensate and concentrated non-condensable gases from the reboiler 17.

The line for withdrawing evaporated black liquor from the evaporator 6 and either said first line 4 or said second line 14, 13 for withdrawing at least one black liquor stream from the digester 5*a*, or both, may be combined for feeding these liquids to said flash tank 15, or are individually directed to said flash tank 15.

The condensate line 12 for withdrawing condensated fresh steam from the evaporator 6 may direct the evaporator condensate to the line 21 for supplying clean, evaporable liquid to the reboiler 17.

The evaporator 6 and the flash tank 15 may be arranged to provide evaporated black liquor having a higher dry solids content than the flashed black liquor.

The condensate line 12 for withdrawing condensated fresh steam from the evaporator 6 may direct the fresh steam condensate as feed water to a recovery boiler plant in the mill.

A pressurized fiber filter 7 may be located in the first line 5 between the digester 5*a* and the evaporator 6 to allow the removal of fiber from the black liquor stream.

The evaporator 6 may be a falling film evaporator which has a plurality of plate or tube heat exchange elements 9, along the outer surfaces of which the black liquor discharged from the digester 5*a* is arranged to flow.

The at least one evaporator 6 may be constituted by two or more evaporators or a multistage evaporator generating vapors having different temperatures, wherein vapor lines are directing said vapors to the digester 5*a* (5*a*) for heating the fibrous material.

The black liquor may be evaporated in the evaporator 6. Fresh steam (the pressure of steam is typically 6-17 bar (g) and the steam may be extraction steam from a turbine) is supplied via line 8 to heat exchange elements 9. The evaporator is typically a falling film evaporator which has a plurality of plate or tube heat exchange elements. The black liquor being evaporated, in other words, the black liquor discharged from the digester 5*a*, is caused to flow along the outer surfaces of the heat exchange elements 9. The secondary vapor generated in the evaporator 6 is directed through line 11 to the top of the digester 5*a* to be used as heating steam. The vapor has typically a temperature of over the cooking temperature, so that the fibrous material is heated to the cooking temperature by the vapor, which is led through the vapor inlet opening of the digester 5*a* which communicates with the vapor space of the evaporator 6. The black liquor can also be evaporated in two or more evaporators or in a multistage evaporator, and the vapors having different temperatures are generated and may be used for heating the fibrous material in the digester 5*a*. The dry-solid content of the black liquor is increased as much as the total evaporation shall be in the evaporator(s). The fresh steam is condensed in the evaporator 6, and fresh steam condensate thus produced is pure and it can be led via line 12 to the mill's recovery boiler plant where it can used as feed water without any purification process.

The quantity of the black liquor to be evaporated depends on the steam flow needed in the digester 5*a*. It is not advantageous to generate excess black liquor vapor in the evaporation by means of fresh steam, which would worsen the heat economy of the mill.

By using the steam from the black liquor evaporator in the digester 5*a* for heating fibrous material, a better heat economy is achieved, because the black liquor is not diluted by adding fresh steam in the digester 5*a*.

Hot black liquor extracted from the digester 5*a* typically at a temperature of 120-160° C. and at a dry solid content of 12-17%, is also led via lines 14, 13 to a flash tank 15 where the pressure of the liquor is decreased to produce flash vapor having typically a temperature of 100-130° C. and flashed black liquor, the dry solid content of which can be increased by 2-4% in flashing. Preferably one or more black liquor streams withdrawn from the digester 5*a* through an outlet or outlets and through lines 4, 14 is/are combined with the evaporated black liquor from the evaporator 6. The flow (kg/s) of the evaporated black liquor is typically smaller than that of the black liquor going directly from the digester 5*a* to the flash tank 15. It is possible to send the evaporated black liquor directly to the mill's evaporation plant, but it is preferable to mix it with unevaporated black liquor to be able to utilize all available heat at a reasonable temperature level. The flashed black liquor is sent via line 18 to the evaporation plant of the mill where the black liquor is concentrated to a high dry solids content before combustion in a recovery boiler.

The energy of the flash steam in line 16 is recovered in a reboiler 17 where the steam is passed in an indirect heat exchange relationship with volatile-compound-free "clean" liquid to heat the water above its boiling point or flash point to produce clean, volatile compound-free, odor-free steam. The clean liquid is fed via line 21. It may typically be evaporator condensate, demineralized water, boiler feed water or clean enough water fraction. The clean steam produced in the reboiler has substantially less noncondensable gases than steam produced by direct black liquor flashing. The clean steam in line 2 is preferably used for pretreating wood chips with steam, e.g. in the chip bin 10. When used to treat chips, since the steam does not introduce volatile compounds to the presteaming process, the load of the volatile compounds which must be collected and treated by a mill's NCG system is reduced.

The flash vapor from the black liquor flash tank 15 contains volatile compounds, such as sulfur compounds. These compounds are passed to a foul condensate and to a concentrated noncondensable gas (CNCG) stream which are generated in the reboiler. The foul condensate is sent from the reboiler via line 19 to the evaporator plant where it is treated in a way known per se. The CNCG stream is led via line 20 to a condenser, e.g. digester 5*a* auxiliary condenser (not shown).

The potential advantages of the system and method disclosed herein include:

a) Mill-wide heat economy will improve, as the dry solid content of the extraction liquor which is led to the evaporation plant of the mill will increase. Increased dry solid content is a consequence of flashing the extraction liquor and the fact that there is no direct steam usage into the digester 5*a*. The steam consumption and capacity demand will decrease in the evaporation plant.

b) Investment cost savings of the evaporation plant decreases due to the lower capacity demand.

c) Fresh steam condensate return increases and thus the mill-wide steam consumption decreases.

d) Methanol recovery of the mill-wide system is improved, as the first evaporated fractions from the black liquor shall be condensed in dedicated heat exchangers (evaporator and reboiler).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A method for generating steam in a digester plant of a chemical pulp mill comprising:

producing black liquor in the digester plant;

extracting a first stream of black liquor from the digester;

generating vapor by evaporating the first stream of black liquor by heating the first stream with fresh steam, wherein evaporated black liquor formed by the evaporation of the first stream is separated from the vapor and the evaporated black liquor has a higher dry-solid content than the dry-sold content of the first stream of black liquor;

heating cellulosic feed material in the digester with the generated vapor separated from the evaporated black liquor;

extracting a second stream of black liquor from the digester;

flashing the second stream of black liquor to generate flashed black liquor and flashed black liquor vapor;

combining the evaporated black liquor produced by the evaporation of the first stream of black liquor and the second stream of black liquor before or during the flashing of the second stream of black liquor;

introducing the flashed black liquor vapor to at least one heat exchanger to indirectly heat a clean evaporable liquid to produce clean steam from the clean evaporable liquid; and steaming, with the clean steam produced in the at least one heat exchanger, the cellulosic feed material before feeding the cellulosic feed material to the digester plant.

2. The method of claim 1 wherein the heat exchanger is a reboiler and the flashed black liquor vapor is introduced to the reboiler.

3. The method of claim 1 wherein the evaporated black liquor produced by evaporating the first stream has a higher dry solids content than does the flashed black liquor.

4. The method of claim 1 wherein the clean evaporable liquid comprises evaporator condensate.

5. The method of claim 1 further comprising producing condensed fresh steam condensate in the heat exchanger and feeding, as feed water, the condensed fresh steam condensate to a recovery boiler plant.

6. A method for generating heat energy for a chemical digester plant comprising:

producing black liquor in a digester vessel of the digester plant;

extracting black liquor from the digester vessel to form a first stream of black liquor;

evaporating the first stream of black liquor by heating the first stream and producing black liquor vapor from the evaporation, wherein evaporated black liquor formed by the evaporation of the first stream is separated from the black liquor vapor, and the evaporated black liquor has a higher dry-solid content than the dry-sold content of the first stream of black liquor;

injecting the black liquor vapor, after separation from the evaporated black liquor, into the digester vessel;

forming a second stream of black liquor which includes the evaporated black liquor and another stream of black liquor extracted from the digester vessel before or during the flashing of the second stream of black liquor;

flashing the second stream of black liquor to generate flashed black liquor and flashed black liquor vapor; passing the flashed black liquor vapor through a heat exchanger to indirectly heat a clean evaporable liquid to produce clean steam, and steaming cellulosic feed material with the clean steam produced and thereafter feeding the cellulosic feed material to the digester vessel.

7. The method of claim 6 wherein the black liquor in the second stream includes black liquor extracted from a lower elevation of the digester vessel than black liquor included in the first stream of black liquor.

8. The method of claim 6 wherein the heat exchanger is a reboiler and the flashed black liquor vapor is introduced to the reboiler.

9. The method of claim 6 wherein the another stream of black liquor is extracted from the digester vessel separately from the first stream and from a lower elevation of the digester vessel than the first stream.

10. The method of claim 6 wherein the clean evaporable liquid comprises evaporator condensate.

* * * * *